US005695392A

United States Patent [19]

Kim

[11] Patent Number: 5,695,392

[45] Date of Patent: Dec. 9, 1997

[54] POLISHING DEVICE WITH IMPROVED HANDLING OF FLUID POLISHING MEDIA

[75] Inventor: Inki Kim, Tempe, Ariz.

[73] Assignee: Speedfam Corporation, Des Plaines, Ill.

[21] Appl. No.: 635,020

[22] Filed: Apr. 19, 1996

Related U.S. Application Data

[63] Continuation-in-part of Ser. No. 512,839, Aug. 9, 1995, abandoned.

[51] Int. Cl.[6] ..... B24B 7/00

[52] U.S. Cl. ..... 451/288; 451/41; 451/285; 451/286; 451/397; 451/398

[58] Field of Search ..... 451/41, 283, 285, 451/286, 287, 288, 397, 398, 388, 387

[56] References Cited

U.S. PATENT DOCUMENTS

| | | | |
|---|---|---|---|
| 2,826,009 | 3/1958 | Shurson | 51/129 |
| 2,883,802 | 4/1959 | Katzke | 451/278 |
| 3,090,169 | 5/1963 | Boettcher | 451/288 |
| 3,375,614 | 4/1968 | Boettcher et al. | 451/288 |
| 3,377,750 | 4/1968 | Day | 451/288 |
| 3,568,371 | 3/1971 | Day et al. | 51/161 |
| 4,519,168 | 5/1985 | Cesna | 51/216 |
| 4,739,589 | 4/1988 | Brehm et al. | 51/281 |
| 5,032,203 | 7/1991 | Doy et al. | 156/345 |
| 5,177,908 | 1/1993 | Tuttle | 451/283 |
| 5,205,082 | 4/1993 | Shendon et al. | 51/283 |
| 5,216,843 | 6/1993 | Breivogel et al. | 51/131 |
| 5,329,732 | 7/1994 | Karlsrud et al. | 51/131 |
| 5,597,346 | 1/1997 | Hempel, Jr. | 451/287 |

FOREIGN PATENT DOCUMENTS 2.224.994 10/1974 France .

*Primary Examiner*—Eileen Morgan
*Attorney, Agent, or Firm*—Fitch, Even, Tabin & Flannery

[57] ABSTRACT

A retainer ring for retaining a thin workpiece during machining thereof, the retaining ring being of a design which facilitates distribution of an abrasive slurry used in the machining operation.

45 Claims, 4 Drawing Sheets

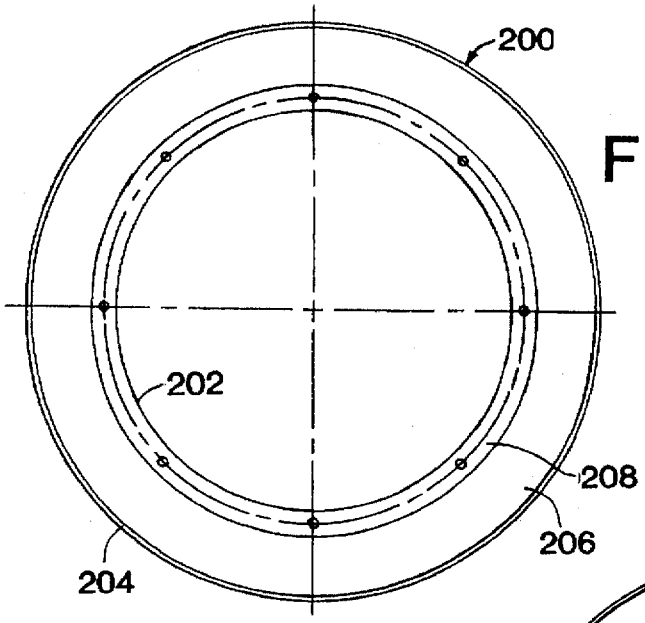
FIG. 8
FIG. 9
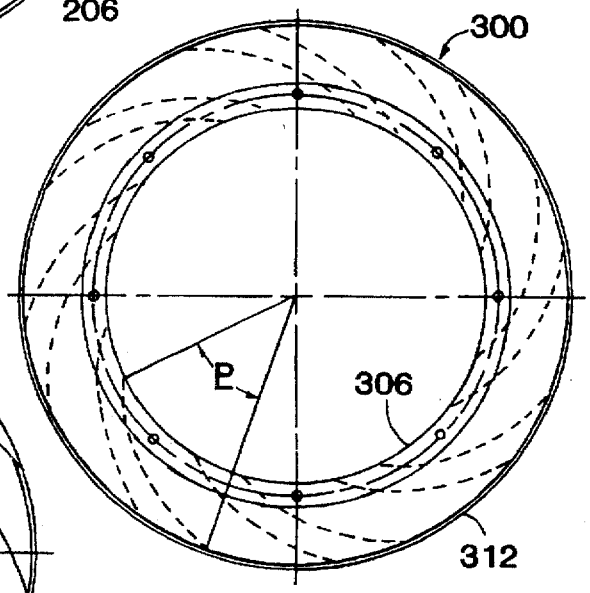
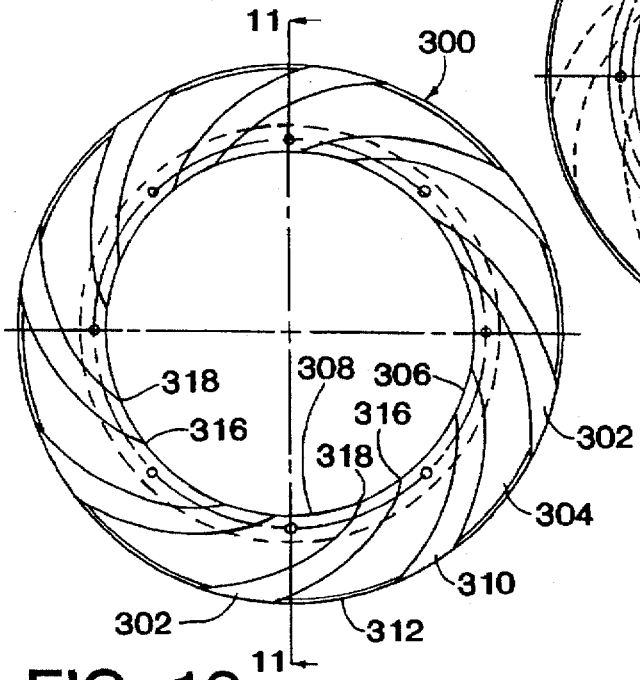
FIG. 10
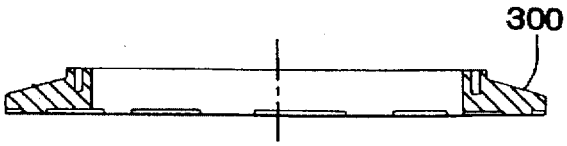
FIG. 11

POLISHING DEVICE WITH IMPROVED HANDLING OF FLUID POLISHING MEDIA

CROSS REFERENCE TO RELATED APPLICATIONS

This is a continuation-in-part of U.S. patent application Ser. No. 08/512,839 filed Aug. 9, 1995, now abandoned.

BACKGROUND OF THE INVENTION

1. Field of the Invention

This invention relates to polishing and planarization of thin workpieces such as silicon wafers used in semiconductors.

2. Description of the Related Art

In machining processes involving polishing or planarization of thin workpieces, such as silicon substrates or wafers used in integrated circuits, a wafer is disposed between a carrier or pressure plate and a rotatable polishing table carrying on its surface a polishing pad. The pressure plate applies pressure so as to effect removal of rough spots from the wafer and to produce a surface of substantially uniform thickness on the wafer.

Generally, the polishing apparatus includes a rigid pressure plate or carrier to which unpolished wafers are adhered, with the wafer surfaces to be polished exposed to a polishing pad which engages the same with polishing pressure. The polishing pad and carrier are then typically both rotated at differential velocities to cause relative lateral motion between the polishing pad and the wafer front side surfaces. An abrasive slurry, such as a colloidal silica slurry, is generally provided at the polishing pad-wafer surface interface during the polishing operation to aid in the polishing.

The preferred type of machine with which the present invention is used includes a rotating polishing wheel which is rotatably driven about a vertical axis. Typically, the polishing wheel comprises a horizontal ceramic or metallic platen which can be formed of various materials, as is known in the art, and which are available commercially. Typically, the polishing pad is a blown polyurethane, such as the IC and GS series of polishing pads available from Rodel Products Corporation of Scottsdale, Ariz. The hardness and density of the polishing pad is routinely selected based on the type of material that is to be polished or planarized. The polishing pad is rotated about a vertical axis and has an annular polishing surface on which the workpieces are placed in confined positions onto which an abrasive slurry, such as an aqueous slurry of silica particles, is pumped. The joint functions of the pad, the slurry, and the relative movements of the components produces a combined mechanical and chemical process at the wafer surface which produces a highly flat surface on a wafer. During the polishing operation the wafers are retained in circular retaining rings to prevent being dislodged from the wafer carrier. Conventional retainer rings are made of a rigid material, such as metal, and are of a size to fit over the wafers to be polished and the pressure or carrier plate. The retaining rings function to prevent the wafers from being displaced from the pressure plate.

Conventional continuous retaining rings tend to inhibit passage of the abrasive slurry into the center of the wafer or substrate being polished. Rather, these conventional retaining rings tend to push the abrasive slurry away from the wafer during polishing which often results in slowing the rate of polishing of the center portion of a wafer. Also, larger amounts of abrasive slurry are required for a polishing operation.

SUMMARY OF THE INVENTION

It is a principal object of this invention to provide a novel device for use in polishing operations.

It is another object of the invention to provide a novel device for retaining a workpiece in position during polishing thereof.

It is another object of the invention to provide a novel device for retaining a workpiece in position during polishing thereof which device reduces the amount of abrasive slurry normally required for a polishing operation.

It is another object of the invention to provide a novel device for retaining a workpiece in position during polishing thereof which improves the efficiency of polishing, particularly polishing of the center portion of a workpiece.

It is another object of the invention to provide a novel device for retaining a workpiece in position during polishing thereof which exhibits good stability during polishing.

These and other objects of the present invention which will become apparent from studying the appended description and drawings are provided in retainer apparatus for polishing a workpiece, comprising:

a pressure plate portion above the workpiece, for applying downward pressure to the workpiece to polish the workpiece against a polishing surface;

a retainer ring portion having upper and lower surfaces, an inner surface cooperating with the pressure plate to define an internal cavity, and an outer surface;

the lower surface of the retainer ring portion defining a plurality of recesses extending from the inner surface to the outer surface, the recesses non-coincident with radial reference lines emanating from a point within the internal cavity; and the recesses having an inner opening of predetermined size at the inner surface and an outer opening at the outer surface, of greater size than the inner opening.

For polishing operations involving thin workpieces, this invention provides a device for surrounding and retaining in place a workpiece during polishing. The retaining device fits over the pressure plate and workpiece and is provided on its lower portion with an enlarged annular extension in which there are a plurality of non-radial channels extending from the outer periphery to the inner periphery. The retaining device of the invention thus acts to direct abrasive slurry into the center of the workpiece during polishing.

BRIEF DESCRIPTION OF THE DRAWINGS

FIG. 8 is a top plan view thereof;

FIG. 9 is a top plan view of yet another embodiment of the invention;

FIG. 10 is a bottom plan view thereof;

FIG. 11 is a cross-sectional view taken along the line 11—11 of FIG. 10; and

DETAILED DESCRIPTION OF THE PREFERRED EMBODIMENTS

Figure 1:
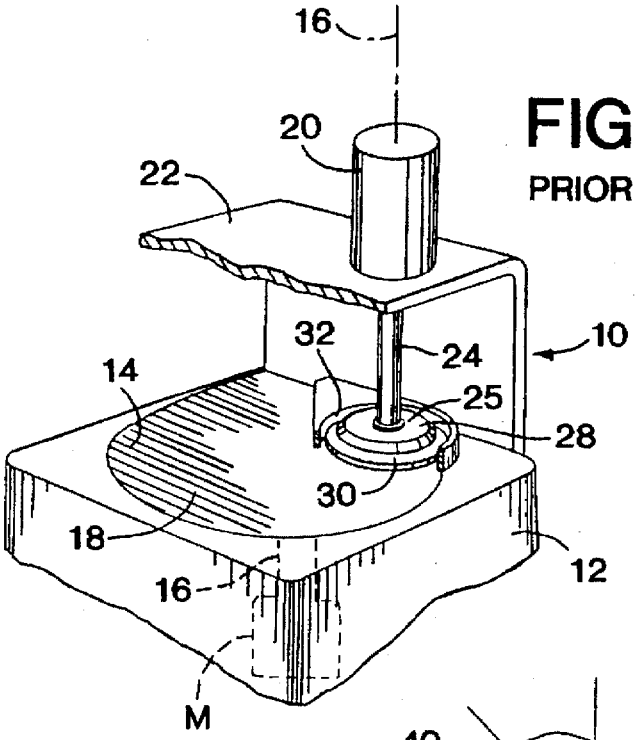
FIG. 1 PRIOR ART
FIG. 1 is a perspective view of typical basic apparatus for polishing a substrate, such as a silicon wafer.

FIG. 1 shows schematically basic elements of typical apparatus for polishing thin workpieces. The illustrated polishing machine 10 has a stationary frame 12 and a rotatable polishing wheel 14 driven by a motor M to rotate in the direction of arrow 15 (in FIG. 2), about a center shaft 16 (see FIG. 1) having an axis of rotation C (see FIG. 2). A polishing pad 18 is carried by the top surface of wheel 14. A power cylinder 20 is mounted on an overlying portion 22 of the frame 12 and presents a rod or shaft 24 that rotatably and tiltably supports at its lower end 25 a pressure plate 28. Operation of the power cylinder therefore raises the pressure plate with clearance well above the polishing wheel 14 and lowers the pressure plate with adjustable forces. The pressure plate 28 is suited to hold at least one workpiece, such as silicon wafer 30, which in turn rests against the polishing pad 18. As shown in FIG. 1, a conventional continuous retaining ring 32 (partially broken away), slightly larger than both the pressure plate 28 and the outer periphery of wafer 30, fits freely over them to keep the wafers under pressure plate 28. As will be noted, the bottom surface of retaining ring 32 is uninterrupted and rests on polishing pad 18 on polishing wheel 14.

Figure 2:
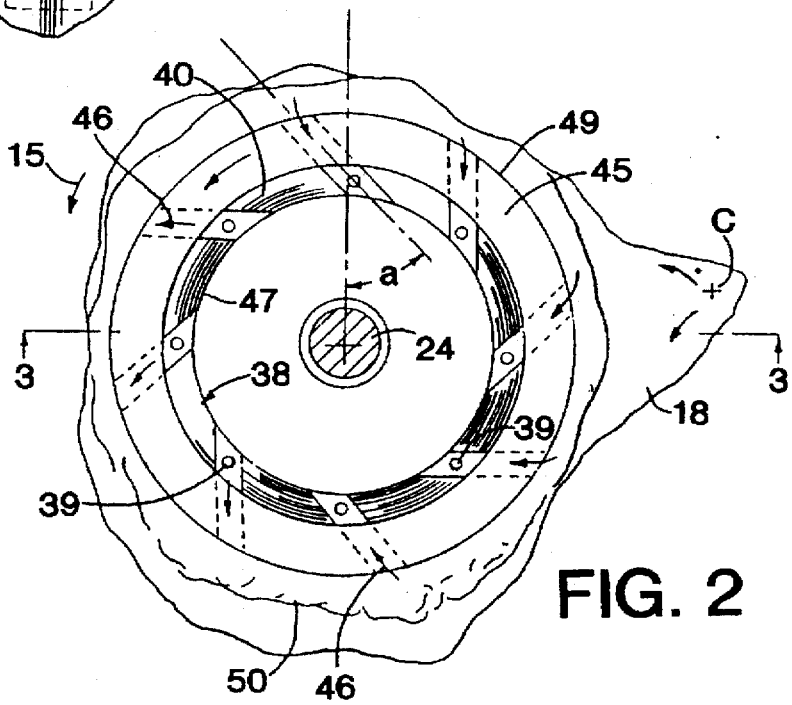
FIG. 2 is a plan view of one embodiment of the retaining device of the invention.
Figure 3:
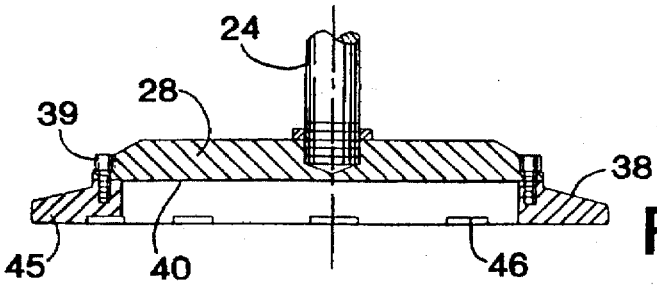
FIG. 3 is a sectional view of the retaining device of the invention taken on the line 3—3 of FIG. 2.
Figure 4:
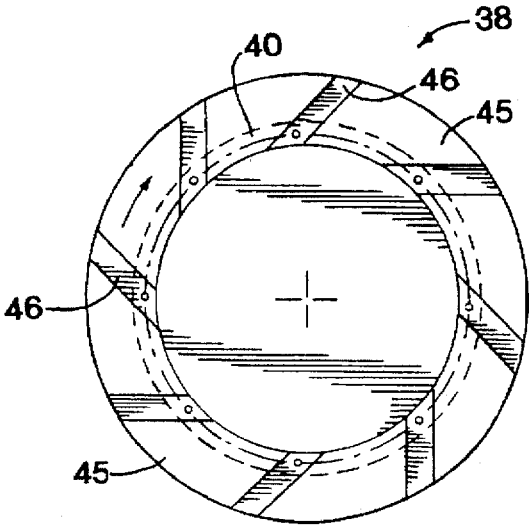
FIG. 4 is a bottom view of one embodiment of the retaining device of the invention.
Figure 5:
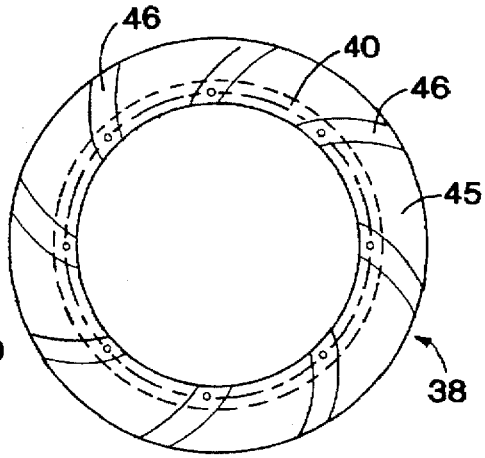
FIG. 5 is a bottom view similar to FIG. 4 showing another embodiment of the invention.

FIGS. 2–4 illustrate a retaining ring 38 in accordance with this invention which, in one embodiment, is formed in two joinable parts. An upstanding ring portion 40 (which is slightly larger than both the pressure plate 28 and the wafer or wafers 30) fits freely over each to keep them in polishing position. The upstanding annular portion 40 of retaining ring 32 is of a height sufficient to embrace the pressure plate 28 when the ring rests on the polishing wheel. As illustrated in FIGS. 2–4, attached by means of screws 39 to the bottom surface 48 of the pressure plate 28 is a relatively wide retaining ring or annular flange member 45 which extends outwardly from pressure plate 28. The flange member 45 has a plurality of non-radial channels 46 spaced along its bottom surface extending from the inner periphery 47 to the outer periphery 49 thereof. It will be noted that channels 46 are not radially disposed, i.e. they are non-coincident with radial reference lines emanating from a point within the retainer ring cavity. Thus, the non-radial configuration of the present invention has reference to retainer rings which are not truly circular, although for economy of application and to more readily achieve uniform polishing across the surface of the workpiece, the retainer rings are preferably circular. In the preferred embodiment, the channels are not radially disposed with respect to the circle formed by the annular ring portion 40 but rather are slanted or obliquely disposed so as to represent a secant with respect to said circle. The number of channels can be varied, but in preferred form, eight channels spaced approximately 45° from each other are provided in the retaining ring used for wafer substrates having a diameter of 6 inches, 8 inches or larger. While the channels 46 are shown in FIG. 2 as being generally linear, the channels can be arcuate in configuration (see FIGS. 5 and 9–12). Such arcuate channels afford greater, more uniform flow of the abrasive slurry 50, as indicated by the arrows in FIGS. 2 and 6, for example.

The two-piece construction of the retaining ring according to this invention has the advantage that conventional continuous retaining rings can be economically used. This is accomplished by simply securing an enlarged channeled flange to the bottom surface of the conventional retaining rings. However, the novel retaining ring according to the invention can be formed in one piece and the number of fluid-carrying channels 46 can be varied as well as the size thereof. For polishing a wafer of 6 inches in diameter, a preferred retaining ring is one with the upstanding annular portion 40 having a diameter of 5.972 inches, a lower flange 45 of 8.618 inches in width and having eight channels 46 0.50 inch in width and 0.078 inch in depth and spaced 45° from one another.

The novel retaining ring of the invention provides significant improvement in polishing or planarization of thin workpieces such as silicon wafers and the like. The new retaining ring directs abrasive polishing slurry 50 in the direction of arrows A into the center of the substrate 30 being polished when the polishing wheel is rotating in counterclockwise direction. When the polishing wheel rotates in clockwise direction, the angles of the flow channels 46 are accordingly changed. It also reduces the amount of slurry required for a particular polishing operation because of more efficient distribution of the slurry. Reduction in use of abrasive slurry is an economic advantage. Also, because of more uniform distribution of abrasive slurry, polishing removal rates are increased with greater polishing uniformity.

The embodiment described above employs channels of generally constant dimensions along their path lengths. For example, the channels shown in FIG. 4 are formed by side walls which are generally parallel to one another and preferably the channels are formed by a constant depth of cut into the stock material from which the retaining ring is formed. If desired, the channels described above can be formed with a varying depth along their path lengths. As will be seen herein, it is preferred in some instances that the channels have a smaller cross-sectional size adjacent the inner diameter of the retaining ring and a greater cross-sectional size adjacent the outer periphery of the retaining ring.

Turning now to FIGS. 6–12, retaining arrangements are shown having flow-augmenting channels of variable cross-sectional size along their path lengths. For example, in FIGS. 6–8, the retaining ring is shown with flow-augmenting channels extending along straight-lined paths. That is, the center points of cross sections taken along the channel generally lie along the common line. Though not essential in all instances, the channels preferably have a constant depth from the inner diameter of the retaining ring to the outer diameter of the retaining ring and the side walls of the channels preferably form parallel lines at the bottom face of the retaining ring, as shown, for example, in FIG. 6.

Figure 12:
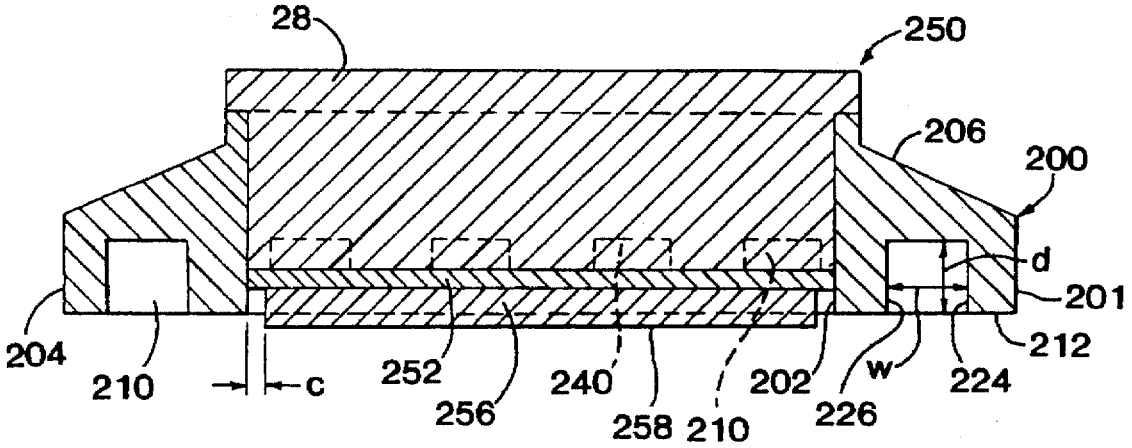
FIG. 12 is a schematic diagram of a cross-sectional view of an arrangement similar to that shown in FIG. 11.

Referring briefly to FIG. 12, a retainer assembly 250 is shown comprising pressure plate 28 and a retainer ring 200. In a preferred embodiment, the pressure plate and retainer ring are separately formed and are secured together with threaded fasteners 39 in a manner shown in FIG. 3. However, if desired, the retainer ring and pressure plate could be formed together from a monolithic piece of suitable stock material, such as a plastic or other non-metallic material, as well as a metallic material such as stainless steel.

As can be seen in the central portion of FIG. 12, the pressure plate extends into the interior bore of retainer ring 200 but does not extend to the underneath side of the retainer ring. Accordingly, an enclosed cavity is formed at the bottom of retainer assembly 250. As indicated in FIG. 12, it is preferred that the internal cavity be dimensioned such that the workpiece to be polished, identified by reference numeral 256 in FIG. 12, extends a predetermined amount below the bottom surface 212 of the retaining ring so as to be exposed to the polishing wheel 14. As will be appreciated from studying FIG. 12, if the retainer ring were made solid, it would be difficult for polishing media to approach the outer periphery of the workpiece 256. One would need to rely on the presence of polishing media trapped when the retainer assembly 250 and workpiece 256 are lowered onto the polishing wheel prepared beforehand with a coating of polishing media. It is generally preferred that the pressure pad 28 be of conventional construction and could, for example, include a vacuum chuck arrangement for holding workpiece 256 in position within the cavity formed at the bottom of the retainer assembly 250. As will be appreciated, any polishing media trapped between the workpiece 256 and the polishing wheel would tend to migrate during a polishing operation, and a desired quantity of polishing media cannot be assured. It is generally preferred that an excess of polishing media be provided so as to allow for an exchange of polishing media at the situs of polishing work being preformed on the workpiece. For example, if the polishing media carries abrasive particles, it is usually important that the size and sharpness of the particles be carefully controlled. It is well known during a polishing operation that these polishing particles tend to break down, often before a polishing operation is completed. Further, portions of the workpiece surface which are free from the workpiece will commingle with the polishing media, changing its physical and chemical composition. For these and other reasons, it is desirable that the polishing media be continually exchanged during a polishing operation. With prior art retainer rings polishing media is observed to build up or "puddle" at the outer periphery of the retaining rings. However, with retainer assemblies according to principles of the present invention, no such build up or puddling at the outer periphery of the retainer rings is observed, providing a visual confirmation that polishing media is flowing across the surface of the workpiece during the polishing operations. With retainer apparatus according to principles of the present invention, the workpiece is satisfactorily retained within a pressure applying apparatus, and is readily adaptable for use with existing equipment. Further, with retaining apparatus according to the principles of the present invention, flow into and out of the region of active polishing is improved in both volume of flow and reliability of flow throughout a polishing operation.

As mentioned above, the channels formed in retaining apparatus according to the principles of the present invention may be either straight-line or curved. In the preferred embodiments described herein, the retaining apparatus has a generally circular configuration with the channels extending in non-radial directions. It is preferred that linear channels of either circular or non-circular retaining rings are oriented at an angle to radial reference lines emanating from a point in the internal cavity within the retainer ring.

Referring briefly to FIGS. 9–11, a further alternative embodiment of a retaining ring 200 is shown with curved channels, i.e. channels which have openings at the inner diameter and outer periphery of the retaining ring which are angularly offset. Preferably, the channels in FIGS. 9–11 are continuously curved although linear approximations of curves are also possible. The channels formed in the retaining rings of FIGS. 6–11, have a smaller cross-sectional size adjacent the inner diameter of the retaining ring and a larger cross-sectional size at the outer periphery of the retaining ring. Preferably, the channels have a constant depth along their path length (although this may not be necessary in all instances) and the channel depth can vary along the path length of the channel. If desired, however, the curved channels can have a constant cross-sectional size at their inner and outer openings.

Figure 6:
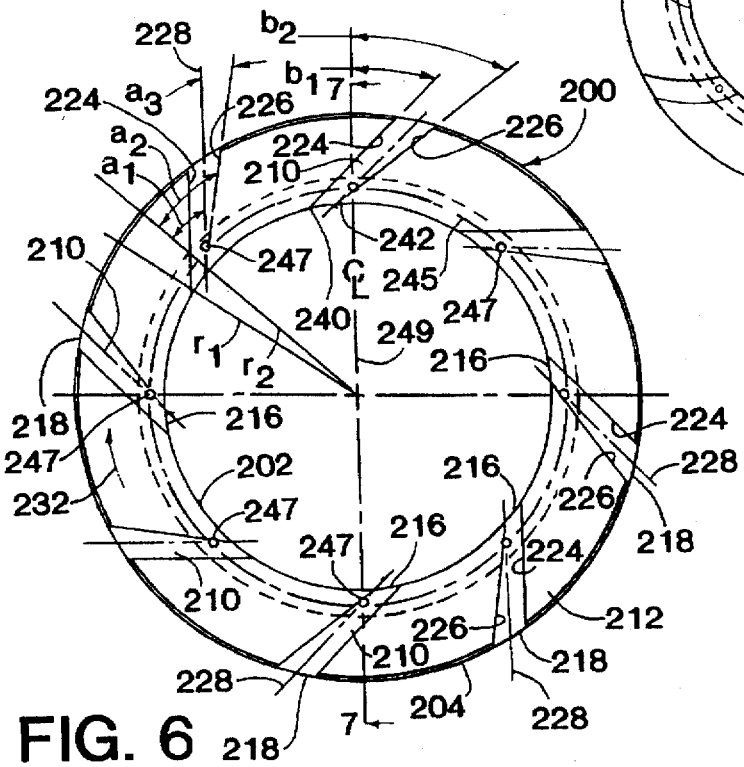
FIG. 6 is a bottom plan view of a further embodiment of the invention.
Figure 7:
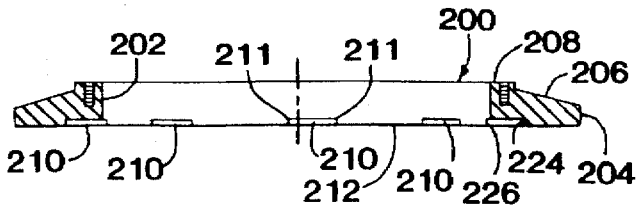
FIG. 7 is a cross-sectional view taken along the line 7—7 of FIG. 6.

Turning now to FIGS. 6–8, the retainer ring is generally indicated at 200. The retainer ring generally resembles the retainer ring described above with reference to FIGS. 2–4. The retainer ring includes an inner diameter wall 202 and an outer peripheral wall 204. Referring to FIG. 7, the retaining ring 200 preferably has an upper beveled surface 206 and an annular land or mounting band 208, which cooperates with the beveled surface 206 to form the stepped profile as can be seen in FIG. 7.

As can be seen in FIGS. 6 and 7, a plurality of flow-augmenting channels 210 are formed in the bottom surface 212 of retaining ring 200. Preferably, the retaining ring is formed from appropriate stock material, such as a filled or unfilled plastic or other non-metallic material. As mentioned, the retaining ring and pressure plate could be formed separately or as a single monolithic part. Plastic molding and other conventional techniques may be employed in this regard. However, if desired, the retainer ring could also be formed from a stainless steel alloy or other material consistent with the chemical systems and forces employed. The channels 210 are preferably formed by milling or otherwise cutting grooves in the bottom surface 212 of the retaining ring. When the retainer ring (or integrated retainer assembly) is formed using molding techniques, it is possible to include the channel structure in the molding process. However, it is preferred that the channels be formed so as to have relatively sharp internal corners 211, a construction feature readily accomplished using conventional economical milling or cutting techniques.

Referring again to FIG. 6, the channels 210 include inlet openings 216 and outlet openings 218. In the embodiment shown in FIGS. 6–8, the channels are formed by opposed walls 224, 226. Preferably, the walls 224, 226 lie along flat planes which are generally perpendicular to the bottom surface 212 of the retaining ring. Although this is the preferred configuration, the walls could be curved i.e. not flat in cross-section), and could be formed at non-perpendicular angles to bottom surface 212.

As a result of the preferred planar construction of the walls 224, 226, the walls form straight lines where they meet the bottom surface 212. FIG. 6 shows construction lines 228 which extend generally parallel to the walls 224, and which intercept the point where walls 226 meet the inner diameter wall 202. Construction lines 228 provide a visual gauge for the amount of "taper" or outward "flaring" of the walls 224, 226. It is preferred that the tapering of the channel walls be configured such that the inlet openings 216 are smaller than the outlet openings 218, with the walls 226 forming an acute angle with the construction lines 228. Referring to FIG. 6, the preferred direction of rotation of the retainer ring is in a clockwise direction as indicated by arrow 232.

Referring to FIG. 6, a bolt circle construction line 245 is shown, about which a plurality of bolt-receiving holes 247 are located. The holes 247 receive bolts 39 shown in FIG. 3. Thus, as can be seen at the top of FIG. 6, wall 226 intersects circular construction line 245 and vertical line 249 at the same point. The wall 224 forms an angle $b_1$ with respect to construction line 249 and the wall 226 forms an angle $b_2$ with respect to the construction line 249. In a preferred embodiment, angle $b_1$ ranges between 40 and 50 degrees, but is most preferably set at 45 degrees, while the angle $b_2$ ranges between 45 and 60 degrees, and most preferably is set at 53 degrees.

As can be seen in FIG. 6, the walls 224, 226 are inclined from radial lines along the direction of arrow 232. The radial line $R_1$ extends to the point of contact between wall 224 and inner diameter wall 202. An angle $a_1$ is formed between radial line $R_2$ and reference line 228. Similarly, a radial line $R_2$ extends to the point of contact between wall 225 and inner diameter wall 202. An angle $a_2$ is formed between wall 225 and radial line $R_2$. Further, an angle $a_3$ is formed between the reference line 228 and wall 226 and provides one indication of the amount of "taper" or "flare" of the enlarged opening of the channels.

In the embodiment shown in FIG. 6, for example, angle $a_1$ is approximately 45°, angle $a_2$ is approximately 60°, and angle $a_3$ is approximately 15°. FIG. 6 shows one preferred example of channel orientations. It is contemplated, however, that a range of configurations of the channels is possible. For example, the angle $a_1$ can range between 40° and 50°, the angle $a_2$ can range between 55° and 65°, and the angle $a_3$ can range between 10° and 20°. While it is most preferred that eight channels be equally spaced about the retaining ring, other numbers of the channels are possible and their spacing need not be uniform. Further, while it is generally preferred that the channels be of similar cross-sectional configuration, channels of different configurations can be employed in the same retaining ring.

Further, other design considerations can be readily accommodated by the present invention. For example, it will be appreciated that the amount of draw through the channels is maximized if the corners 240, 242 (where the walls 224, 226 meet the inner diameter wall 202—see FIG. 6) are made sharp, and are not radiused or rounded over. However, these corners, and particularly corner 240, are exposed to a workpiece located within the retaining ring. In one commercial embodiment of the retaining ring 200, inner diameter wall 202 is a size slightly larger than a single circular workpiece located within the retaining ring. For example, retaining rings dimensioned to accept workpieces having a six inch outer diameter provide a maximum clearance of approximately 1.5 millimeters between the outer periphery of the workpiece disk and the inner wall 202.

Polishing operations can be carried out either with or without a relative rotation of the retaining ring with respect to the polishing table. However, the workpiece is free to rotate and move within the inner diameter wall 202 of the retaining ring and this is commonly observed in a practical polishing operation. At times, circular workpieces have been observed to "bounce off" the inner diameter wall 202 at a relatively frequent rate and careful consideration has been given to the effect of the workpiece impacting the inner diameter wall 202 of the retaining ring. As will be appreciated from observing the retainer ring shown in FIG. 6, it is possible that a six inch diameter workpiece may contact the inner diameter wall 202 (which has a diameter 1.5 millimeter larger than the six inch diameter workpiece), and can, on occasion, directly impact against the corner 242 and especially the corner 240. This condition is aggravated in workpieces having various identification or orientation flats formed in their outer periphery. In the semi-conductor fabrication industry, circular workpieces of varying constructions and materials are routinely identified by different orientation flats formed in the outer periphery of the workpiece. Due to the high cost of workpieces in this industry, it is important that deleterious effects of an orientation flat of a workpiece impinging on a corner of a retaining ring channel be minimized or eliminated. Accordingly, it is preferred for six inch diameter workpieces, that the width or distance between the corners 240, 242 be no larger than ⅜ of an inch, and most preferably be no larger than ¼ of an inch. The preferred size of the outlet opening 218 ranges between a width slightly larger than 0.5 inch and 1.5 inches. In the preferred embodiment shown in FIG. 6, the depth of the channels is generally constant and is preferably deeper than the thickness of the workpiece, most preferably between two and three times greater than the thickness of the workpiece.

As those familiar with the semi-conductor fabrication art are aware, non-uniform polishing of substrate discs is an important concern to semi-conductor device manufacturers, especially when orientation flats or other asymmetries in the workpiece are present. For example, it has been commonly observed that polishing media tends to build up at the location of orientation flats formed in the outer periphery of a workpiece. With channels constructed according to principles of the present invention, non-uniform polishing rates at the locations of orientation flats has been drastically reduced and in many applications substantially eliminated. Further, with channeled retainer arrangements constructed according to principles of the present invention, uniformity of polishing rates across the surface of the workpiece, in general, has been observed. This results in an increase in both global and local planarization of a workpiece undergoing polishing with retaining arrangements according to principles of the present invention, a feature of substantial economic importance to manufacturers of semi-conductor devices. Of course, the retaining arrangements described herein may be readily applied to polishing operations on other materials, such as machine parts and other items which are in common commercial use today.

Turning now to FIG. 12, a cross-sectional view similar to that shown in FIG. 7 is illustrated in diagrammatic form. It will be observed that the schematic drawing of FIG. 12 is not drawn to scale. FIG. 12 shows a retention arrangement generally indicated at 250, comprising the retainer ring 200, the pressure plate 28 and an optional backing film 252 made of $SF_3$ or other material. The width of the channel, w, varies from the inner wall 202 to the outer periphery 204 as explained above. In a preferred embodiment, the depth d of the channel 210 is held constant along the length of the channel and is the same for the several channels formed in the retaining ring. In the arrangement shown in FIG. 12, the workpiece 256 comprises a wafer of semi-conductor material having a thickness ranging between 630 and 690 microns. The film 252 has a thickness ranging between 400 and 450 microns. The clearance or gap c has a maximum value of approximately 1.5 millimeters (and assumes that the workpiece is contacting the inner wall 202). In the preferred embodiment, the bottom surface 258 extends a distance ranging between 150 and 175 microns below the bottom surface 212 of the retaining ring. As schematically illustrated in FIG. 12, the channels 210 extend above the height of the workpiece, and in the preferred embodiment, the depth d is approximately 2 millimeters.

Turning now to FIGS. 9–11, a retainer ring is generally indicated at 300. A series of channels 302 are formed in the bottom surface 304 of the retaining ring and have an opening 306 at the inner wall 308 of the retaining ring and an opening 310 in the outer periphery 312 of the retaining ring. As in the preceding embodiment, it is generally preferred that the corners 316, 318 be made sharp so as to improve the draw of media to the channel and it is also preferred that the opening 306 at the inner diameter be made smaller than the opening 310 at the outer periphery of the retaining ring. For a six inch diameter workpiece and with the clearance and thickness dimensions described above with reference to FIG. 12, the opening 306 at the inner diameter is preferably no larger than ⅜ inch, and most preferably is no larger than ¼ inch, while the opening 310 of the outer periphery ranges between ¼ inch and 2 inches. Although virtually any number of channels can be employed, it is most preferred that eight channels are equally spaced about the bottom surface of the retaining ring. Further, it is generally preferred that the inlet and outlet openings be offset no more than 90 degrees as measured by radial lines passing through centers of the openings, and it is preferred that the angular offset between inlet and outlet openings lie within a range between 40 and 50 degrees, and it is most preferred that the angular offset P be approximately 45 degrees (see FIG. 9).

Those modifications and equivalents which fall within the spirit of the invention are to be considered a part thereof.

What is claimed is:

1. A retainer apparatus for polishing a workpiece, comprising:

a pressure plate portion above the workpiece, for applying downward pressure to the workpiece to polish the workpiece against a polishing surface;

a retainer ring portion having upper and lower surfaces, an inner surface cooperating with the pressure plate to define an internal cavity for receiving at least the upper portion of the workpiece, and an outer surface;

the lower surface of the retainer ring portion defining a plurality of recesses communicating with the cavity interior extending from the inner surface to the outer surface, the recesses noncoincident with radial reference lines emanating from a point within the internal cavity; and the recesses having a generally constant depth with an inner opening of predetermined width at the inner surface and an outer opening at the outer surface, of greater width than the inner opening.

2. The retainer apparatus of claim 1 wherein the recesses extend along respective straight lines.

3. The retainer apparatus of claim 2 wherein the straight lines are angularly offset from the radial reference lines.

4. The retainer apparatus of claim 2 wherein the straight lines are angularly offset similar amounts from the radial reference lines.

5. The retainer apparatus of claim 1 wherein the recesses extend along respective curved lines.

6. The retainer apparatus of claim 5 wherein the curved lines are offset in similar directions from the radial reference lines.

7. The retainer apparatus of claim 1 wherein the recesses have generally the same depth.

8. The retainer apparatus of claim 1 wherein the recesses form sharp corners at their inner openings.

9. The retainer apparatus of claim 8 wherein the recesses have generally rectangular cross-sections.

10. The retainer apparatus of claim 1 wherein the pressure plate extends into the internal cavity of the retainer ring.

11. The retainer apparatus of claim 1 wherein the pressure plate and retainer ring are separately formed.

12. The retainer apparatus of claim 1 wherein the pressure plate and retainer ring are integrally formed so as to comprise a monolithic body.

13. A retainer ring apparatus for polishing a workpiece, comprising:

a retainer ring having upper and lower surfaces, mounting means for joining the retainer ring to a pressure plate at the upper surface of the retainer ring, an inner surface defining an internal cavity for receiving at least the upper portion of the workpiece within the retainer ring, and an outer surface;

the lower surface of the retainer ring defining a plurality of recesses communicating with the cavity interior extending from the inner surface to the outer surface, the recesses noncoincident with radial reference lines emanating from a point within the internal cavity; and the recesses having a generally constant depth with an inner opening of predetermined width at the inner surface and an outer opening at the outer surface, of greater width than the inner opening.

14. The retainer ring apparatus of claim 13 wherein the recesses extend along respective straight lines.

15. The retainer ring apparatus of claim 14 wherein the straight lines are angularly offset from the radial reference lines.

16. The retainer ring apparatus of claim 15 wherein the straight lines are angularly offset similar amounts from the radial reference lines.

17. The retainer ring apparatus of claim 13 wherein the recesses extend along respective curved lines.

18. The retainer ring apparatus of claim 17 wherein the curved lines are offset in similar directions from the radial reference lines.

19. The retainer ring apparatus of claim 13 wherein the recesses have generally the same depth.

20. The retainer ring apparatus of claim 13 wherein the recesses form sharp corners at their inner openings.

21. The retainer ring apparatus of claim 20 wherein the recesses have generally rectangular cross-sections.

22. A retainer ring for polishing a workpiece, comprising:

a retainer ring body having upper and lower surfaces, mounting means for joining the retainer ring to a pressure plate at the upper surface of the retainer ring, an inner surface defining an internal cavity within the retainer ring for receiving at least the upper portion of the workpiece, and an outer surface;

the lower surface of the retainer ring defining a plurality of recesses communicating with the cavity interior extending from the inner surface to the outer surface, the recesses extending along respective curved lines, so as to be noncoincident with radial reference lines emanating from a point within the internal cavity; and the recesses having a generally constant depth with an inner opening of predetermined width at the inner surface and an outer opening at the outer surface, of greater width than the inner opening.

23. The retainer apparatus of claim 22 wherein the curved lines are offset in similar directions from the radial reference lines.

24. The retainer apparatus of claim 22 wherein the recess inner openings are of predetermined size and the outer openings are of greater size than the inner opening.

25. The retainer apparatus of claim 24 wherein the recesses have generally the same depth.

26. The retainer apparatus of claim 22 wherein the recesses form sharp corners at their inner openings.

27. The retainer apparatus of claim 26 wherein the recesses have generally rectangular cross-sections.

28. A retainer apparatus for polishing a workpiece, comprising:

a pressure plate portion above the workpiece, for applying downward pressure to the workpiece to polish the workpiece against a polishing surface;

a retainer ring portion having upper and lower surfaces, an inner surface cooperating with the pressure plate to define an internal cavity for receiving at least the upper portion of the workpiece, and an outer surface;

the lower surface of the retainer ring portion defining a plurality of recesses communicating with the cavity interior extending from the inner surface to the outer surface, the recesses extending along respective curved lines so as to be noncoincident with radial reference lines emanating from a point within the internal cavity; and the recesses having a generally constant depth with an inner opening of predetermined width at the inner surface and an outer opening at the outer surface, of greater width than the inner opening.

29. The retainer apparatus of claim 28 wherein the curved lines are offset in similar directions from the radial reference lines.

30. The retainer apparatus of claim 28 wherein the recesses have generally the same depth.

31. The retainer apparatus of claim 28 wherein the recesses form sharp corners at their inner openings.

32. The retainer apparatus of claim 31 wherein the recesses have generally rectangular cross-sections.

33. The retainer apparatus of claim 28 wherein the pressure plate extends into the internal cavity of the retainer ring.

34. The retainer apparatus of claim 28 wherein the pressure plate and retainer ring are separately formed.

35. The retainer apparatus of claim 28 wherein the pressure plate and retainer ring are integrally formed so as to comprise a monolithic body.

36. The retainer apparatus of claim 28 wherein the recess inner openings are of predetermined size and the outer openings are of greater size than the inner opening.

37. A retainer apparatus for polishing a workpiece, comprising:

a pressure plate portion above the workpiece, for applying downward pressure to the workpiece to polish the workpiece against a polishing surface;

a retainer ring portion having upper and lower surfaces, an inner surface cooperating with the pressure plate to define an internal cavity, and an outer surface;

the lower surface of the retainer ring portion defining a plurality of recesses extending from the inner surface to the outer surface, the recesses extending along respective straight lines noncoincident with radial reference lines emanating from a point within the internal cavity; and the recesses having an inner opening of predetermined size at the inner surface and an outer opening at the outer surface, of greater size than the inner opening.

38. The retainer apparatus of claim 37 wherein the straight lines are angularly offset from the radial reference lines.

39. The retainer apparatus of claim 37 wherein the straight lines are angularly offset similar amounts from the radial reference lines.

40. A retainer ring apparatus for polishing a workpiece, comprising:

a retainer ring having upper and lower surfaces, mounting means for joining the retainer ring to a pressure plate at the upper surface of the retainer ring, an inner surface defining an internal cavity within the retainer ring, and an outer surface;

the lower surface of the retainer ring defining a plurality of recesses extending from the inner surface to the outer surface, the recesses extending along respective straight lines noncoincident with radial reference lines emanating from a point within the internal cavity; and the recesses having an inner opening of predetermined size at the inner surface and an outer opening at the outer surface, of greater size than the inner opening.

41. The retainer ring apparatus of claim 40 wherein the straight lines are angularly offset from the radial reference lines.

42. The retainer ring apparatus of claim 41 wherein the straight lines are angularly offset similar amounts from the radial reference lines.

43. Polishing apparatus for polishing a workpiece, comprising:

a polishing wheel having a substantially continuous polishing surface;

a pressure plate portion above the polishing wheel, for applying downward pressure to the workpiece to polish the workpiece against the polishing surface;

a retainer ring portion having upper and lower surfaces, an inner surface cooperating with the pressure plate to define an internal cavity for receiving the upper portion of the workpiece, and an outer surface;

the lower surface of the retainer ring portion defining a plurality of recesses extending from the inner surface to the outer surface, the recesses extending along respective straight lines, noncoincident with radial reference lines emanating from a point within the internal cavity; and the recesses having an inner opening of predetermined size at the inner surface and an outer opening at the outer surface, of greater size than the inner opening.

44. The retainer apparatus of claim 43 wherein the straight lines are angularly offset from the radial reference lines.

45. The retainer apparatus of claim 43 wherein the straight lines are angularly offset similar amounts from the radial reference lines.

* * * * *